US005721560A

United States Patent [19]

Cathey, Jr. et al.

[11] Patent Number: 5,721,560

[45] Date of Patent: Feb. 24, 1998

[54] FIELD EMISSION CONTROL INCLUDING DIFFERENT RC TIME CONSTANTS FOR DISPLAY SCREEN AND GRID

[75] Inventors: David A. Cathey, Jr.; William Lewis; Glen E. Hush; Steven Howell, all of Boise, Id.

[73] Assignee: Micron Display Technology, Inc., Boise, Id.

[21] Appl. No.: 509,501

[22] Filed: Jul. 28, 1995

[51] Int. Cl.[6] ..... H01J 1/30; H01J 19/24

[52] U.S. Cl. ..... 345/74; 313/495

[58] Field of Search ..... 345/55, 74–75, 345/214–215; 315/169.1, 168.167, 337, 160; 313/495

[56] References Cited

U.S. PATENT DOCUMENTS

| | | | |
|---|---|---|---|
| 3,500,102 | 3/1970 | Crost et al. | 313/109 |
| 3,671,798 | 6/1972 | Lees | 313/336 |
| 3,754,177 | 8/1973 | O'Reilly . | |
| 4,437,042 | 3/1984 | Morais et al. . | |
| 4,874,891 | 10/1989 | Spindt | 313/309 |
| 4,908,539 | 3/1990 | Meyer | 315/169.3 |
| 5,012,153 | 4/1991 | Atkinson et al. . | |
| 5,210,472 | 5/1993 | Casper et al. | 315/349 |
| 5,212,426 | 5/1993 | Kane | 315/169 |
| 5,283,500 | 2/1994 | Kochanski | 315/58 |
| 5,347,201 | 9/1994 | Liang et al. . | |
| 5,359,256 | 10/1994 | Gray | 313/169 |
| 5,378,939 | 1/1995 | Marsland et al. . | |
| 5,378,962 | 1/1995 | Gray et al. | 313/495 |
| 5,485,131 | 1/1996 | Fajen et al. . | |
| 5,521,560 | 5/1996 | Burns et al. . | |
| 5,525,868 | 6/1996 | Browning . | |
| 5,529,331 | 6/1996 | Doan et al. . | |
| 5,581,159 | 12/1996 | Lee et al. . | |
| 5,587,720 | 12/1996 | Fukuta et al. . | |

OTHER PUBLICATIONS

Harry Mileaf, *Electronics One–Seven*, 1978, pp. 1–139 to 1–140.

Notes on Using the Spindt–type Field Emission Cathode, Capp Spindt, SRI Intrnational, Menlo Park, CA, Oct., 1976.

*Field Emission Displays*, David A. Cathey, Jr. Published in VLSI, Taiwan, May–Jun., 1995.

*Primary Examiner*—Mark R. Powell

*Attorney, Agent, or Firm*—Stephen A. Gratton

[57] ABSTRACT

A method for controlling a field emission display to reduce emission to grid during turn on and turn off is provided. A field emission display (FED) includes emitter sites formed on a baseplate; a grid for controlling electron emission from the emitter sites; a display screen for collecting electrons to form an image and a power supply. In order to reduce emission to grid during turn on, the display screen is enabled by the power supply prior to enabling of the emitter sites. An anode-baseplate voltage differential is thus established prior to electron emission. For turn on, the method includes varying the capacitances of the control circuits for the display screen and grid such that a time constant (RC) for the grid is larger than a time constant (RC) for the display screen. Alternately the method of the invention can be implemented during turn on using software, using time delay circuit components, or using an emitter site control circuit to control electron flow to the emitter sites. During turn off, the electron emission and anode-baseplate voltage differential are eliminated while a path to ground is provided for the grid.

39 Claims, 3 Drawing Sheets

FIELD EMISSION CONTROL INCLUDING DIFFERENT RC TIME CONSTANTS FOR DISPLAY SCREEN AND GRID

This invention was made with Government support under Contract No. DABT63-93-C-0025 awarded by Advanced Research Project Agency ("ARPA"). The government has certain rights in this invention.

FIELD OF THE INVENTION

The present invention relates to field emission displays (FEDs) and to a method for reducing emission to grid during turn on and turn off of an FED.

BACKGROUND OF THE INVENTION

Flat panel displays have recently been developed for visually displaying information generated by computers and other electronic devices. These displays can be made lighter and require less power than conventional cathode ray tube displays. One type of flat panel display is known as a cold cathode field emission display (FED).

A cold cathode FED uses electron emissions to illuminate a cathodoluminescent screen and generate an image. A single pixel 10 of a prior art FED is shown in FIG. 1A. The FED pixel 10 includes a substrate 11 formed with a conductive layer 12. An array of emitter sites 13 are formed on the conductive layer 12. Although each pixel 10 typically contains many emitter sites (e.g., 4–20 for a small display and several hundred for a large display), for simplicity only one emitter site 13 is shown in FIG. 1A. A grid 15 is associated with the emitter sites 13 and functions as a gate electrode. The grid 15 is electrically isolated from the conductive layer 12 by an insulating layer 18. The grid 15/conductive layer 12/substrate 11 subassembly is sometimes referred to as a baseplate.

Cavities 23 are formed in the insulating layer 18 and grid 15 for the emitter sites 13. The grid 15 and emitter sites 13 are in electrical communication with a power source 20. The power source 20 is adapted to bias the grid 15 to a positive potential with respect to the emitter sites 13. When a sufficient voltage differential is established between the emitter sites 13 and the grid 15, a Fowler-Nordheim electron emission is initiated from the emitter sites 13. The voltage differential for initiating electron emission is typically on the order of 20 volts or more.

Electrons 17 emitted at the emitter sites 13 collect on a cathodoluminescent display screen 16. The display screen 16 is separated from the grid 15 by an arrangement of electrically insulating spacers 22. The display screen 16 is the anode in this system and the emitter sites 13 are the cathode. The display screen is biased by the power source 20 (or by a separate anode power source) to a positive potential with respect to the grid 15 and emitter sites 13. In some system the potential at the display screen 16 (i.e., anode-baseplate voltage differential) is on the order of 1000 volts or more. The display screen 16 includes an external glass face 14, a transparent electrode 19 and a phosphor coating 21. Electrons impinging on the phosphor coating 21 cause the release of photons 25 which forms the image.

One method of addressing the field emitter sites 13 for use in video displays is taught by Crost et al. in U.S. Pat. No. 3,500,102. In this method the emitter sites 13 are electrically connected and placed parallel to additional rows of emitter sites. The grids 15 associated with the emitter sites 13 are electrically connected in parallel columns which are orthogonal to the emitter rows. The emitter sites 13 associated with each pixel 10 of the FED are uniquely defined by the intersection point of a specific emitter row and a specific grid column. Electrically addressing a row while simultaneously addressing a column activates a specific pixel 10.

Another method for addressing the field emitter sites 13 for use in video displays is disclosed by Casper et al. in U.S. Pat. No. 5,210,472. In this method, a common grid electrode is employed with respect to all of the pixels in the display. Addressing of the pixels within the display as taught by Casper et al. is accomplished with row and column electrodes which provide access for emitter sites 13 to a source of electrons.

One problem in a FED that occurs during the turn on process (i.e., power up) is the emission of electrons from the emitter sites 13 to the grid 15. Emission to grid during turn on is illustrated in FIG. 1B. During the turn on process, electrons 26 emitted from the emitter sites 13 may go directly to the grid 15 rather than to the display screen 16. This situation can lead to overheating of the grid 15. The emission to grid can also affect the voltage differential between the emitter sites 13 and grid 15. In addition, desorped molecules and ions 28 can be ejected from the grid 15 causing excessive wear of the emitter sites 13. Electron emission to grid can also lead to electrical arcing 30 between the grid 15 and the conductive layer 12 or emitter sites 13. In addition, electrons 26 emitted from the emitter sites 13 can strike the spacers 22 causing a charge build up on the spacers 22.

All of these problems decrease the lifetime, performance and reliability of the FED. Electron emission to grid is particularly a problem in consumer electronic products, such as camcorders, televisions and automotive displays, which are typically turned on and off many times throughout the useful lifetime of the product.

One reason for the electron emission to grid, is that electron emission may have commenced from the emitter sites 13 before the large anode-baseplate voltage potential has been established at the display screen 16. Typically the display screen 16 is a relatively large, relatively high voltage structure which requires some period of time to reach full potential across its entire surface. In addition, the display screen 16 operates at a significantly higher voltage than any other component of the FED. Some period of time is required to ramp up to this operating voltage. Consequently, the display screen 16 can be at a low enough positive potential to allow electron emission to grid 15 to occur, as illustrated in FIG. 1B. Although this situation may only occur for a relatively short period of time, it can cause system problems as outlined above.

A related situation can also occur during turn on of the display screen 16 and grid 15 if the emitter sites 13 are not electrically controlled. If the emitter sites 13 are not limited during power on an uncontrolled amount of emission can occur causing the same problems as outlined above.

In addition, a similar situation exists during the turn off process for the FED cell 10 (i.e., power off). If power to the large positive potential at the display screen 16 is lost prior to termination of electron emission from the emitter sites 13, then electron emission to grid, as illustrated in FIG. 1B, can occur.

The present invention recognizes that electron emission to grid during turn on, can be controlled by allowing the display screen of an FED to reach full positive potential prior to emission from the emitter sites. At the same time electrical control of the emitter sites should be established prior to the display screen and grid being turned on such that the emitter sites are not allowed to float. Thus when electron emission is initiated from the emitter sites, the electrons will be attracted to the display screen rather than to the grid. The present invention further recognizes that electron emission to grid during turn off can be controlled by terminating electron emission from the emitter sites prior to eliminating the positive potential at the display screen.

OBJECTS OF THE INVENTION

In view of the foregoing, it is an object of the present invention to provide an improved method for controlling field emission displays to prevent electron emission to grid during turn on and turn off.

It is yet another object of the present invention to provide an improved method of turn on and turn off for an FED for reducing electron emission to grid.

It is a further object of the present invention to provide an improved circuit arrangement adapted to reduce electron emission to grid during turn on and turn off of an FED.

Other objects, advantages and capabilities of the present invention will become more apparent as the description proceeds.

SUMMARY OF THE INVENTION

In accordance with the present invention, a method for controlling a field emission display (FED) to reduce electron emission to grid during turn on and turn off is provided. Such an FED includes emitter sites formed on a baseplate; a grid for controlling electron emission from the emitter sites; a display screen (anode) for collecting the electrons to form a visual image; and a power source.

For controlling emission to grid during turn on, the method of the invention, simply stated, comprises enabling the display screen prior to enabling of the emitter sites. This allows the display screen to reach positive potential prior to electron emission from the emitter sites. A large anode-baseplate voltage differential can thus be established between the emitter sites and display screen prior to electron emission. When electron emission begins, the electrons are attracted to the display screen rather than to the grid.

Electrical control of the emitter sites should be established prior to turn on of the grid. For an active matrix FED, the solid state devices at the emitter sites should be powered prior to enabling the grid. This assures that the emitter sites are in a known state and are not floating. In a matrix FED having patterned grid electrodes for addressing pixels, video information is loaded onto the grid electrodes and the grid electrodes are switched on and off to vary the emission. For a passive matrix FED, to insure that the display screen is powered on before the grid, the video information to the grid should be delayed.

In an illustrative embodiment, the display screen is enabled prior to the grid by controlling the capacitance of the control circuitry for the grid and the display screen. In particular the grid control circuit is constructed with a capacitance that results in a greater time delay during power on of the display than for the delay introduced by the capacitance in the display control circuit. This provides a greater time constant (RC) for the grid control circuitry which in turn provides the required time delay during power up of the electron emission relative to power up of the display screen.

For controlling electron emission to grid during turn off, the method of the invention, simply stated, comprises eliminating electron emission from the emitter sites prior to disabling the display screen. For turn off, the control circuitry for the grid is constructed with a path to ground that is activated at turn off. This insures that electron emission terminates without initiating emission to grid.

In addition to controlling capacitances, the method of the invention can be implemented using specific time delay circuit components (e.g., capacitors, switches, voltage trip circuits) or by using software. Using software, the system turn on can be controlled, such that the display screen is enabled prior to enablement of the baseplate and emitter sites. In a similar manner, software can be used to insure that the electron emission from the emitter sites is terminated at turn off.

The method of the invention can also be implemented by controlling the current path and thus the flow of electrons to the emitter sites. This can be accomplished using NMOS FETs to control current to the emitter sites. In the turn on mode, the electron flow to the emitter sites is not initiated until the display screen has reached full potential. In the turn off mode electron flow is terminated prior to power off to the display screen. At the same time a path to ground for the grid is provided.

DETAILED DESCRIPTION OF THE INVENTION

Figure 1A:
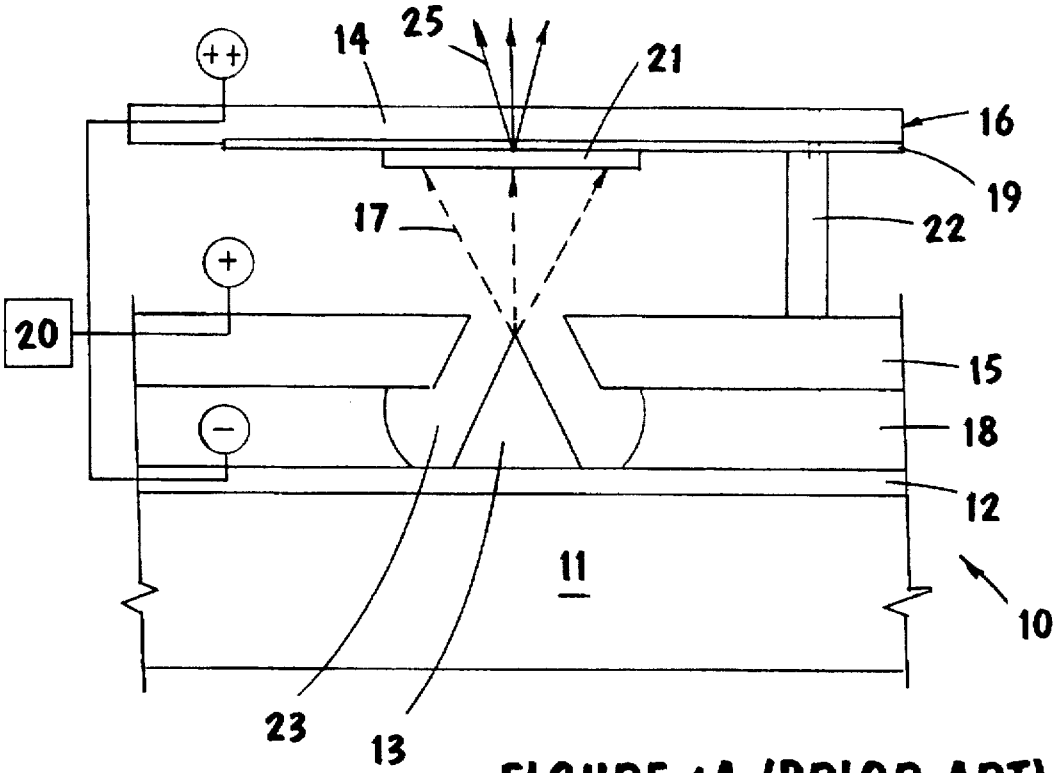
FIGURE 1A (PRIOR ART)
FIG. 1A is a schematic cross sectional view of a pixel of a prior art field emission display (FED)
Figure 1B:
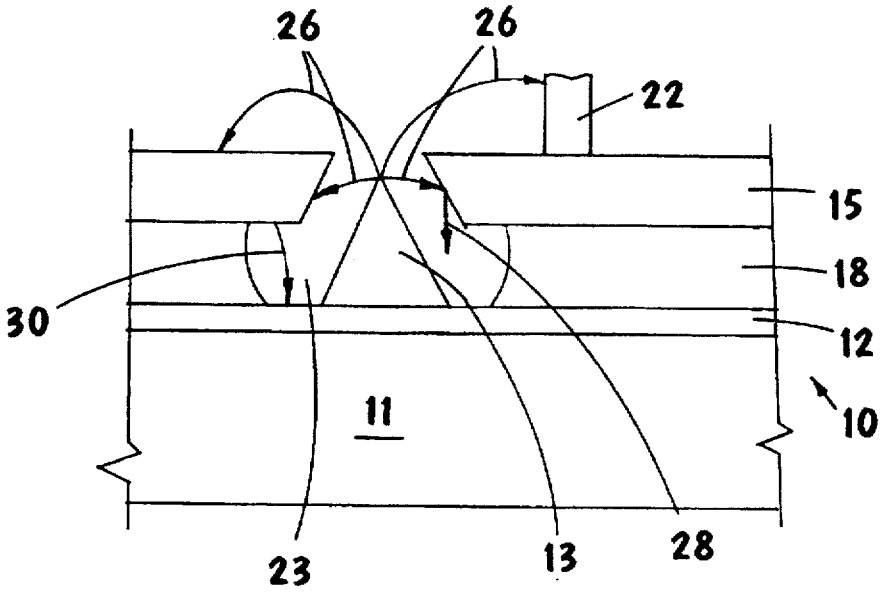
FIGURE 1B (PRIOR ART)
FIG. 1B is a schematic cross sectional view illustrating emission from the grid occurring during turn on or turn off for the prior art field emission display pixel shown in FIG. 1A.
Figure 2:
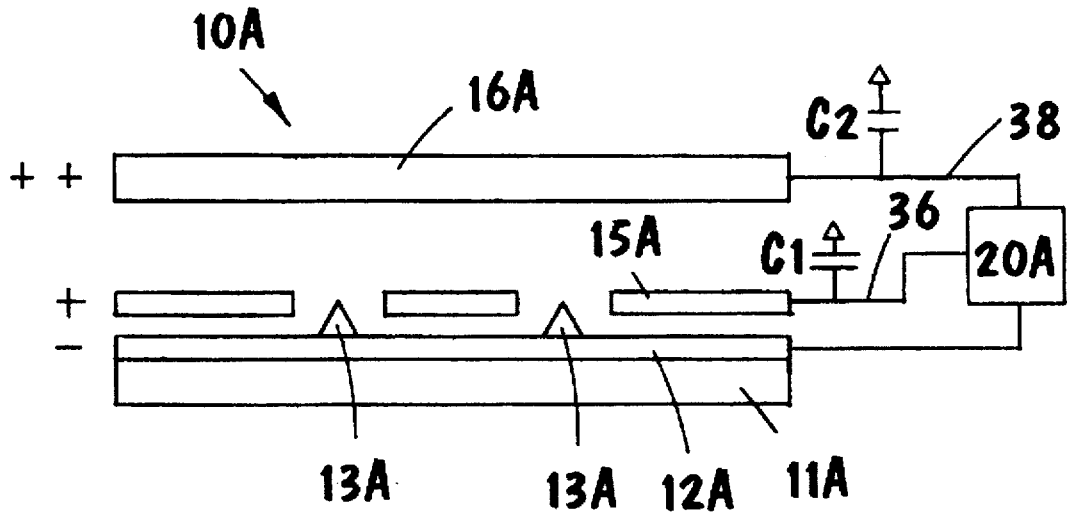
FIG. 2 is a schematic electrical diagram of an FED constructed in accordance with the invention adapted to control emission to grid during turn on and turn off.

Referring to FIG. 2, an FED pixel 10A constructed in accordance with the invention is shown. The FED pixel 10A is adapted to control emission to grid during turn on and turn off. The FED pixel 10A is constructed substantially as previously described and includes a baseplate 11A; emitter sites 13A and conductive layer 12A formed on the baseplate 11A; a grid 15A which functions as a gate element for the emitter sites 13A; a display screen 16A (anode) for collecting electrons emitted by the emitter sites 13A; and a power source 20A in electrical communication with the emitter sites 13A, grid 15A and display screen 16A.

The FED contains a large number of pixels 10A. In addition, depending on the design of the FED, a single pixel 10A contains a number of emitter sites 13A. The emitter sites 13A and grid 15A are addressable through a matrix of rows and columns. An emitter site 13A is activated by simultaneously activating the column and row for that emitter site (i.e., intersection of activated column and row).

At an activated emitter site 13A, a grid to emitter voltage differential sufficient to induce field emission is established.

A grid control circuit 36 electrically connects the grid 16 to the power supply 20A. To initiate emission from the emitter sites 13A, the grid 15A is biased by the control circuit 36 to an electrical potential that is positive (+) with respect to the emitter sites 13A. The grid to emitter voltage differential necessary to initiate electron emission is on the order of 20–100 volts or more. The grid control circuit 36 includes a path to ground and is formed with an overall capacitance C1.

A display control circuit 38 electrically connects the display screen 16A to the power supply 20A. The display screen 16A is biased by the display control circuit 38 to an electric potential that is more positive (++) than the emitter sites 13A. This is the anode-baseplate voltage differential. The electric potential at the display screen 16A is on the order of 300–1200 volts. Because of this large anode-baseplate voltage differential, electrons emitted from an activated emitter site 13A are attracted to the display screen 16A which upon collection of the electrons releases photons substantially as previously described. The display control circuitry 38 includes a path to ground and is formed with an overall capacitance of (C2).

For reducing emission to grid during turn on, the FED pixel 10A is constructed such that the total capacitance (C1) of the grid control circuit 36 is greater than the total capacitance (C2) of the display control circuit 38. The time constant (RC) for the grid control circuit 36 is therefore greater than the time constant (RC) for the display control circuit 38. At turn on, the emitter sites 13A, grid 15A and display 16A are powered by the power supply 20A. Because of the differing time constants for the display control circuit 38 and grid control circuit 36, the display screen 16A is enabled prior to the grid 15A. This provides a staggered turn on for the grid 15A and display 16A and the anode-baseplate voltage differential is established prior to electron emission from the emitter sites 13A. The grid control circuit 36 can be constructed with a total capacitance (C1) that is greater than the total capacitance (C2) of the display control circuit 38 using techniques that are known in the art. For control circuits constructed as "hybrids" or "multi-chip modules", the inherent capacitance of the circuit is largely a function of the length of the interconnect lines used for the circuits. The RC time constant is thus also proportional to the length of the interconnect lines. Accordingly, the length of the interconnect lines for the grid control circuit 36 and the display control circuit 38 can be adjusted to achieve the required relative total capacitances C1 and C2 (i.e., C1>C2). Additionally, capacitors can be added to the grid control circuit 36 to increase its capacitance C1 as required. Furthermore, since the RC time constants control the turn on, a staggered turn on can also be accomplished by adjusting the resistance of each circuit.

In an active matrix FED, the control circuitry for the emitter sites 13A should be in a known state and not floating. If the emitter sites 13A are floating then emission is not regulated and an uncontrolled emission can occur.

Figure 4:
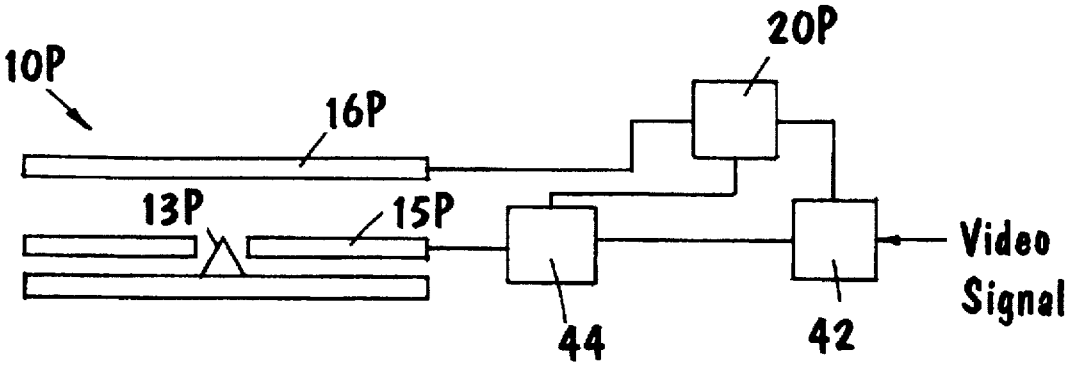
FIG. 4 is a schematic electrical diagram of a passive matrix FED constructed in accordance with the invention with delay circuitry adapted to delay video information to the grid.

In a matrix FED with patterned grid electrodes for addressing the pixels, no grid location is constantly on. Rather video information to the grid generates different levels of emission for grayscale generation. Such a matrix FED is sometimes referred to as a passive matrix FED. For practicing the method of the invention, during turn on of a passive matrix FED, video information to the grid is delayed until the display screen has been turned on. This can be accomplished using software, delay circuitry or RC delays. FIG. 4 illustrates such a delay circuit 42 for a pixel 10P of a passive matrix FED. The delay circuit 42 delays the video information to the grid driver 44. The emitter site 13P, grid 15P, display screen 16P and power supply 20P for the passive matrix pixel 10P can be formed substantially as previously described.

For reducing emission to grid during turn off, the grid control circuit 36 is constructed to provide a path to ground at turn off. With this arrangement power can be cut to the grid 15A to eliminate electron emission. Additionally, the grid 15A is taken to ground potential faster than the display screen 16A. This arrangement eliminates emission to grid during turn off.

In addition to varying relative capacitances, the method of the invention can be implemented during turn on using control circuits constructed with time delay components or delayed circuit paths. The method of the invention can also be implemented with software adapted to control the grid control circuit 36 and display control circuit 38 to provide a staggered turn on for the grid 15A and display 16A.

Figure 3:
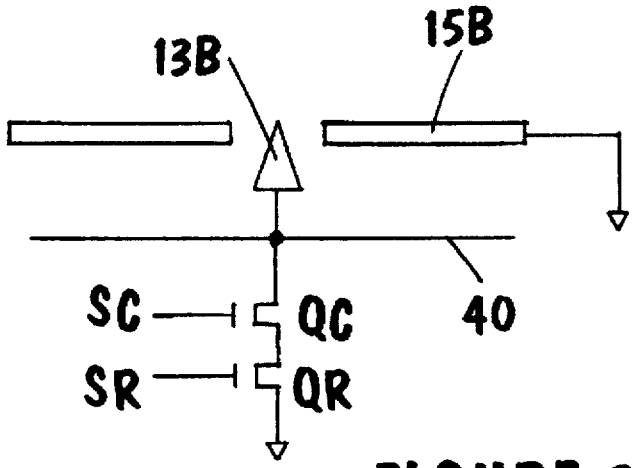
FIG. 3 is a schematic electrical diagram of an FED constructed in accordance with the invention with an emitter site control circuit adapted to control emission to grid during turn on and turn off.

The method of the invention can also be implemented by controlling the electron flow to the emitter sites. The electron flow can be controlled using NMOS FETs in electrical communication with the emitter sites and to ground potential. This is shown in FIG. 3. In FIG. 3 the emitter site 13B is electrically connected to a base electrode 40. The base electrode 40 is coupled to a pull down node and is maintained at ground potential through a pair of series-coupled field effect transistors (FETs) $Q_C$ and $Q_R$. Transistor $Q_C$ is gated by a column signal $S_C$ and transistor $Q_R$ is gated by a row signal $S_R$. Standard logic signal voltages can be used for both column and row signal lines.

The FETs $Q_C$ and $Q_R$ can be used to turn the flow of electrons to the emitter sites 13B on and off as required. In the turn on mode, electron flow to the emitter sites 13B is not initiated until the display screen 16A (FIG. 2) has reached full potential. In the turn off mode electron flow is terminated prior to power off to the display screen 16A. At the same time a path to ground for the grid 15B is provided. An emitter site 13B is turned off (i.e., placed in a non-emitting state) by turning off either or both of the series connected FETs $Q_C$ and $Q_R$.

Figure 5:
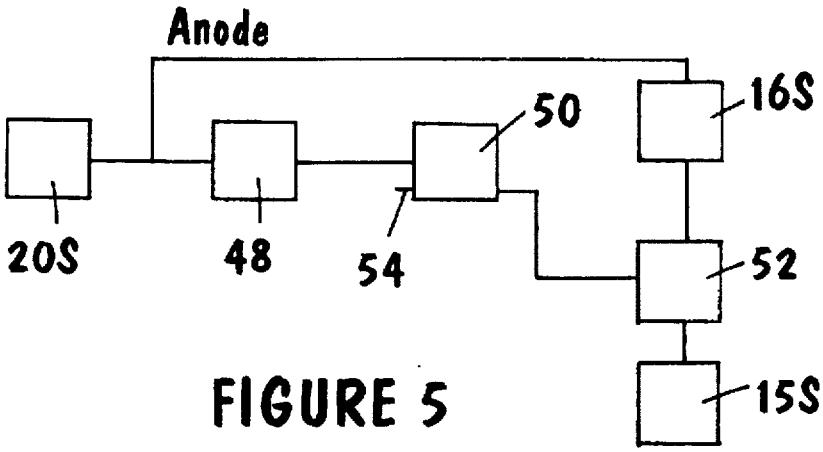
FIG. 5 is a schematic electrical diagram of an control arrangement for controlling emission to grid in a FED constructed in accordance with the invention.

As shown in FIG. 5, the method of the invention can also be implemented using sense circuitry 48 to sense the anode voltage and to turn on the grid supply 20S depending on the voltage level of the display screen 16S. When the anode voltage rises above a certain level the grid 15S is turned on. When the display screen 16S falls below a certain level the grid 15S is pulled to ground. A comparator 50 with a set point 54 trips relay circuitry 52 that turns the grid 15S on and off.

Thus the invention provides a method for controlling emission to grid during turn on and turn off of an FED. While the method of the invention has been described with reference to certain preferred embodiments, as will be apparent to those skilled in the art, certain changes and modifications can be made without departing from the scope of the invention as defined by the following claims.

What is claimed is:

1. A method for controlling a field emission display comprising:

providing the field emission display with emitter sites for emitting electrons, a grid for controlling electron emission from the emitter sites, and a display screen for collecting the electrons;

enabling the display screen to establish a voltage differential between the display screen and the emitter sites; and following enabling of the display screen, enabling the grid by delaying electron emission from the emitter sites until the voltage differential has been established to direct the electrons towards the display screen and prevent the electrons from striking the grid.

2. The method as claimed in claim 1 wherein delaying electron emission comprises providing a display control circuit with a first capacitance for enabling the display screen and a grid control circuit with a second capacitance greater than the first capacitance for enabling the grid.

3. The method as claimed in claim 1 wherein delaying electron emission comprises providing a grid control circuit with a time delay component.

4. The method as claimed in claim 1 wherein delaying electron emission comprises providing a display control circuit with a first time constant for enabling the display screen and a grid control circuit with a second time constant greater than the first time constant for enabling the grid.

5. The method as claimed in claim 1 wherein delaying electron emission comprises providing an emitter site control circuit configured to control current to the emitter sites.

6. The method as claimed in claim 1 further comprising providing a path to ground for the grid during turn off of the field emission display to prevent emission to grid during turn off.

7. The method as claimed in claim 1 further comprising controlling an electrical state of the emitter sites prior to enabling the display screen.

8. The method as claimed in claim 1 wherein the field emission display comprises a passive matrix display and further comprising delaying video signals to the grid while enabling the display.

9. A method for controlling a field emission display comprising:

providing the field emission display with emitter sites for emitting electrons, a grid for controlling electron emission from the emitter sites, and a display screen for collecting the electrons;

providing a grid control circuit for controlling power to the grid, said grid control circuit having a first RC time constant;

providing a display control circuit for controlling power to the display screen, said display control circuit having a second RC time constant that is less than the first RC time constant; and applying power through the display control circuit to the display screen and through the grid control circuit to the grid, with the second RC time constant providing a time delay relative to the first RC time constant, in order to establish a voltage differential at the display screen prior to electron emission from the emitter sites.

10. The method as claimed in claim 9 further comprising providing a path to ground for the grid control circuit during turn off of the field emission display for reducing electron emission to grid during turn off.

11. The method as claimed in claim 9 wherein the grid control circuit includes circuit elements for increasing the first RC time constant.

12. The method as claimed in claim 9 wherein the grid control circuit includes an interconnect line configured to increase the first RC time constant.

13. A method for controlling a field emission display comprising:

providing a plurality of field emitter sites;

providing a grid for controlling electron emission from the emitter sites;

providing a display screen for collecting electrons emitted by the emitter sites to form an image;

providing a power source for establishing an anode-baseplate voltage differential between the emitter sites and display screen and for establishing a voltage differential between the grid and emitter sites sufficient to initiate electron emission;

providing a grid control circuit for controlling a conductive path from the power source to the grid, said grid control circuit having a first capacitance;

providing a display control circuit for controlling a conductive path from the power source to the display screen, said display control circuit having a second capacitance that is less than the first capacitance; and establishing the anode-baseplate voltage differential prior to electron emission from the emitter sites by enabling the display screen and the grid while delaying electron emission with a time delay resulting from the first and second capacitance.

14. The method as claimed in claim 13 wherein the grid control circuit comprises circuit elements for increasing the first capacitance.

15. The method as claimed in claim 13 further comprising controlling electron emission to the grid during turn off by turning off power to the emitter sites prior to turning off power to the display screen.

16. The method as claimed in claim 13 further comprising providing a path to ground through the grid control circuit during turn off of the field emission display for reducing electron emission to grid during turn off.

17. A method for controlling a field emission display comprising:

providing a plurality of emitter sites on a baseplate;

providing an emitter site control circuit for controlling current flow to the emitter sites;

providing a grid for controlling electron emission from the emitter sites;

providing a display screen for collecting electrons emitted by the emitter sites to form an image;

providing a power source for establishing an anode-baseplate voltage differential between the emitter sites and display screen and for establishing a voltage differential between the grid and emitter sites sufficient to initiate electron emission;

controlling current flow to the emitter sites with the emitter site control circuit to delay electron emission from the emitter sites until the anode-baseplate voltage differential has been established.

18. The method as claimed in claim 17 wherein the emitter site control circuit comprises a field effect transistor gated by a logic signal.

19. The method as claimed in claim 18 wherein the emitter site control circuit comprises a pair of series connected field effect transistors gated by a column signal and a row signal respectively.

20. The method as claimed in claim 19 wherein electron flow from the emitter sites is controlled by turning off either of the field effect transistors.

21. In a field emission display a method for controlling electron emission during turn off comprising:

providing emitter sites on a baseplate in electrical communication with a power supply;

providing a grid in electrical communication with the power supply, said grid configured to establish a voltage differential of the grid relative to the emitter sites sufficient to initiate electron emission therefrom;

providing a display screen in electrical communication with the power supply, said display screen configured to collect electrons emitted from the emitter sites to form an image;

terminating electron emission from the emitter sites by eliminating the voltage differential between the emitter sites and grid; and providing a path to ground for the grid during the terminating electron emission step.

22. A method for controlling a field emission display comprising:

providing a baseplate comprising emitter sites for emitting electrons and a grid for controlling electron emission from the emitter sites;

providing a display screen configured to collect electrons emitted by the emitter sites to form an image;

enabling the display screen to establish an anode-baseplate voltage differential between the display screen and the emitter sites; and following establishing of the anode-baseplate voltage differential enabling the grid to initiate electron emission from selected emitter sites, with the electrons emitted by the selected emitter sites attracted to the display screen rather than to the grid to prevent electron emission to grid.

23. The method as claimed in claim 22 wherein a delay circuit in electrical communication with the grid is configured to enable the grid following establishing the anode-baseplate voltage differential.

24. The method as claimed in claim 22 wherein a control circuit in electrical communication with the grid has a first RC constant which is greater than a second RC constant for a control circuit in electrical communication with the display screen.

25. A method for controlling a field emission display comprising:

providing a baseplate comprising emitter sites for emitting electrons and a grid for controlling electron emission from the emitter sites;

providing a display screen configured to collect electrons emitted by the emitter sites to form an image;

sensing a voltage of the display screen;

comparing the voltage to a set point voltage;

enabling the grid only after the voltage exceeds the set point voltage such that electrons emitted by the emitter sites are attracted to the display screen rather than to the grid.

26. A field emission display comprising:

a baseplate;

a plurality of emitter sites on the baseplate;

a grid on the baseplate for controlling electron emission from the emitter sites;

a display screen spaced from the baseplate configured to collect electrons emitted from the emitter sites to form an image;

a display control circuit configured to enable the display screen, said display control circuit having a first RC time constant; and a grid control circuit configured to enable the grid, said grid control circuit having a second RC time constant greater than the first RC time constant, said first and second RC time constants allowing a voltage differential to be established between the display screen and emitter sites prior to electron emission from the emitter sites to prevent electron emission to grid during turn on of the field emission display.

27. The display as claimed in claim 26 wherein the emitter sites are configured in rows and columns.

28. The display as claimed in claim 26 wherein the grid includes patterned grid electrodes configured to receive video information.

29. The display as claimed in claim 26 wherein the grid control circuit includes circuit elements for increasing the second RC time constant.

30. A field emission display comprising:

a baseplate;

a plurality of emitter sites on the baseplate;

a grid on the baseplate for controlling electron emission from the emitter sites;

a display screen spaced from the baseplate configured to collect electrons emitted from the emitter sites to form an image; and an emitter site control circuit configured to control a flow of electrons to the emitter sites, said emitter site control circuit allowing a voltage differential to be established between the display screen and emitter sites prior to electron emission from the emitter sites to prevent electron emission to grid during turn on of the field emission display.

31. The display as claimed in claim 30 wherein the emitter sites are configured in rows and columns.

32. The display as claimed in claim 30 wherein the grid includes patterned grid electrodes configured to receive video information.

33. A field emission display comprising:

a baseplate;

a plurality of emitter sites on the baseplate;

a grid on the baseplate for controlling electron emission from the emitter sites;

a display screen spaced from the baseplate configured to collect electrons emitted from the emitter sites to form an image;

a display control circuit configured to enable the display screen; and a grid control circuit configured to enable the grid, said grid control circuit including a time delay component for allowing a voltage differential to be established between the display screen and emitter sites prior to electron emission from the emitter sites to prevent electron emission to grid during turn on of the field emission display.

34. The display as claimed in claim 33 wherein the emitter sites are configured in rows and columns.

35. The display as claimed in claim 33 wherein the grid includes patterned grid electrodes configured to receive video information.

36. A field emission display comprising:

a baseplate;

a plurality of emitter sites on the baseplate;

a grid on the baseplate for controlling electron emission from the emitter sites;

a display screen spaced from the baseplate configured to collect electrons emitted from the emitter sites to form an image;

a display control circuit configured to enable the display screen;

a grid control circuit configured to enable the grid or to ground the grid; and a sensing circuit in electrical communication with the grid control circuit for sensing a first voltage level of the display screen to permit enabling of the grid by the grid control circuit, and for sensing a second voltage level of the display screen to permit grounding of the grid by the grid control circuit.

37. The display as claimed in claim 36 wherein the sensing circuit includes a comparitor.

38. The display as claimed in claim 36 wherein the emitter sites are configured in rows and columns.

39. The display as claimed in claim 36 wherein the grid includes patterned grid electrodes configured to receive video information.

* * * * *